US007899368B2

(12) United States Patent
Yoshida et al.

(10) Patent No.: US 7,899,368 B2
(45) Date of Patent: Mar. 1, 2011

(54) DEVELOPMENT DEVICE, AND IMAGE FORMING APPARATUS AND PROCESS CARTRIDGE USING THE DEVELOPMENT DEVICE

(75) Inventors: Satoru Yoshida, Sagamihara (JP); Hiroya Hirose, Sagamihara (JP); Kiyonori Tsuda, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 676 days.

(21) Appl. No.: 11/748,533

(22) Filed: May 15, 2007

(65) Prior Publication Data

US 2007/0264052 A1 Nov. 15, 2007

(30) Foreign Application Priority Data

May 15, 2006 (JP) ..... 2006-135217

(51) Int. Cl.
*G03G 15/08* (2006.01)

(52) U.S. Cl. ..... 399/254; 399/256; 399/120

(58) Field of Classification Search ..... 399/30, 399/43, 254, 258
See application file for complete search history.

(56) References Cited

U.S. PATENT DOCUMENTS 5,659,860 A 8/1997 Sasaki et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,915,155 A 6/1999 Shoji et al.
5,999,772 A 12/1999 Kakitani et al.
6,035,168 A * 3/2000 Masuda et al. ..... 399/254
6,198,895 B1 3/2001 Tsuda et al.

(Continued)

FOREIGN PATENT DOCUMENTS

EP 1 533 665 A1 5/2005

(Continued)

OTHER PUBLICATIONS

U.S. Appl. No. 12/015,803, filed Jan. 17, 2008, Hirose.

(Continued)

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A development device includes a developer carrying member, developer supply, developer collection and developer agitation conveyance paths, transfer and communication openings, and partition. The developer carrying member bears a two-component developer. The developer supply and developer collection conveyance paths respectively convey the two-component and collected developers in the first direction. The developer agitation conveyance path conveys excess and collected developers in a second direction while agitating to supply the agitated developers to the developer supply conveyance path. The partition separates the developer collection, developer supply, and developer agitation conveyance paths. The transfer opening transfers the collected developer from the first to the second direction. The communication opening, disposed at a further upstream side of the developer collection conveyance path than the transfer opening in the first direction and at a higher position than the developer collection conveyance path, communicates the developer collection conveyance path with the developer agitation conveyance path.

19 Claims, 8 Drawing Sheets

U.S. PATENT DOCUMENTS

| | | | | |
|---|---|---|---|---|
| 6,337,957 | B1 | 1/2002 | Tamaki et al. | |
| 6,522,855 | B1 | 2/2003 | Katoh et al. | |
| 6,882,812 | B2 * | 4/2005 | Kasahara et al. | 399/120 |
| 7,003,255 | B2 | 2/2006 | Kawasumi et al. | |
| 7,024,133 | B2 | 4/2006 | Nagashima et al. | |
| 7,062,207 | B2 | 6/2006 | Tsuda et al. | |
| 7,072,602 | B2 | 7/2006 | Hatori et al. | |
| 7,076,192 | B2 | 7/2006 | Tsuda et al. | |
| 7,110,696 | B2 | 9/2006 | Murakami et al. | |
| 7,136,610 | B2 | 11/2006 | Arai et al. | |
| 7,146,122 | B2 | 12/2006 | Hatori et al. | |
| 7,162,189 | B2 | 1/2007 | Tsuda et al. | |
| 7,184,691 | B2 | 2/2007 | Kita et al. | |
| 7,212,767 | B2 | 5/2007 | Hosokawa et al. | |
| 2004/0223790 | A1 | 11/2004 | Hosokawa et al. | |
| 2005/0226656 | A1 | 10/2005 | Tsuda et al. | |
| 2006/0051136 | A1 | 3/2006 | Tsuda et al. | |
| 2006/0083555 | A1 | 4/2006 | Uchiyama et al. | |
| 2006/0216085 | A1 | 9/2006 | Murakami et al. | |
| 2007/0025773 | A1 | 2/2007 | Tateyama et al. | |
| 2007/0098448 | A1 | 5/2007 | Hart et al. | |
| 2007/0160392 | A1 * | 7/2007 | Tsuda et al. | 399/254 |

FOREIGN PATENT DOCUMENTS

| | | |
|---|---|---|
| JP | 05-333691 | 12/1993 |
| JP | 06-051634 | 2/1994 |
| JP | 11-167260 | 6/1999 |
| JP | 2001-249545 | 9/2001 |
| JP | 2001-290368 | 10/2001 |
| JP | 2003-263012 | 9/2003 |
| JP | 2004-077587 | * 11/2004 |

OTHER PUBLICATIONS

U.S. Appl. No. 12/019,984, filed Jan. 25, 2008, Tsuda, et al.
U.S. Appl. No. 12/020,172, filed Jan. 25, 2008, Tsuda, et al.
U.S. Appl. No. 09/148,509, filed Sep. 4, 1998, Kakitani, et al.
U.S. Appl. No. 12/042,848, filed Mar. 5, 2008, Kita, et al.
U.S. Appl. No. 12/059,392, filed Mar. 31, 2008, Tateyama, et al.
U.S. Appl. No. 12/110,055, filed Apr. 25, 2008, Sakata, et al.
U.S. Appl. No. 12/135,413, filed Jun. 9, 2008, Terai, et al.
U.S. Appl. No. 11/750,746, filed May 18, 2007, Hirose, et al.
U.S. Appl. No. 12/166,951, filed Jul. 2, 2008, Miyamoto, et al.
U.S. Appl. No. 12/238,815, filed Sep. 26, 2008, Utsunomiya, et al.
U.S. Appl. No. 12/250,046, filed Oct. 13, 2008, Tsuda.

* cited by examiner

DEVELOPMENT DEVICE, AND IMAGE FORMING APPARATUS AND PROCESS CARTRIDGE USING THE DEVELOPMENT DEVICE

CROSS-REFERENCE TO RELATED APPLICATION

This patent application is based on Japanese patent application, No. 2006-135217 filed on May 15, 2006 in the Japan Patent Office, the entire contents of which are incorporated by reference herein.

BACKGROUND OF THE INVENTION

1. Field of the Invention

Exemplary aspects of the present invention relate to a development device, and more particularly to a development device using a two-component developer. In addition, the exemplary aspects of the present invention also relate to an image forming apparatus and a process cartridge using a development device.

2. Description of the Related Art

A related art development device, which employs a two-component developer including a toner and a magnetic carrier, for use in an image forming apparatus includes a supply conveyance path and an agitation conveyance path to circulate the developer. The supply conveyance path supplies the developer to a developer carrying member while conveying the developer to a direction parallel to the axis of an image carrying member. The agitation conveyance path conveys the developer in a direction opposite to the supply conveyance path while agitating the developer.

In a such development device, the developer thus supplied to the developer carrying member passes a development region, and is collected in the supply conveyance path. The toner in the developer is consumed in the development region and, the developer is mixed with the developer within the supply conveyance path. The more developer located on the downstream portion of the supply conveyance path, the greater the amount of developer particles passing through the development region. Consequently, the more developer located downstream of the supply conveyance path in a developer conveyance direction, the lower the toner density the developer has. When the toner density decreases, the image density of an image developed by the developer decreases. In other words, the image density of an image varies at the upstream side and downstream side in the developer conveyance direction of the conveyance path in which the developer is supplied to the developer carrying member, resulting in generation of an uneven density image.

In addition, the developer used for development is collected through the agitation conveyance path. The developer reaching the end of the downstream side of the agitation conveyance path in the developer conveyance direction is transferred to the end of the upstream side of the supply conveyance path in the developer conveyance direction. The developer collected at a position closer to the downstream side of the agitation path in the developer conveyance direction is agitated for a shorter time period. Accordingly, the developer collected at the downstream side of the developer conveyance direction of the agitation conveyance path is immediately supplied to the supply conveyance path. This immediate supply of the collected developer causes inadequate agitation of the developer, resulting in non-uniform charging of the toner, thereby decreasing of the image density even if the toner density is maintained at an appropriate level.

One example attempts to reduce the deterioration of the toner density and image density by providing an additional conveyance path serving as a collection conveyance path in a development device. Specifically, the development device as well as the collection conveyance path include a supply conveyance path and an agitation conveyance path. The supply conveyance path is disposed at substantially the same level as that of the developer carrying member to convey and supply the developer to the developer carrying member. The collection conveyance path is disposed below the developer carrying member to collect and convey the collected developer. The agitation conveyance path is disposed at substantially the same level as that of the collection conveyance path and below the supply conveyance path. The agitation conveyance path agitates excess developer reaching the end of the downstream side of the supply conveyance path relative to the developer conveyance direction, and the collected developer reaching the end of the downstream side of the collection conveyance path relative to the developer conveyance direction. The supply conveyance path, collection conveyance path and agitation conveyance path are disposed to be parallel to the developer carrying member. The conveyance paths are separated from one another by separation members. One separation member is disposed between the end of the downstream side of the agitation conveyance path and the supply conveyance path, and includes an opening so that the agitated developer is transferred to the supply conveyance path through the opening. Another separation member is disposed between the end of the downstream side of the supply conveyance path and the agitation conveyance path, and includes an opening so that the excess developer is transferred to the agitation conveyance path through the opening. Still another separation member is disposed between the end of the downstream side of the collection conveyance path and the agitation path, and includes an opening so that the collected developer is transferred to the agitation conveyance path through the opening. By providing an additional collection conveyance path, the developer can be supplied and collected independently.

The collection conveyance path is disposed below the developer carrying member in such a manner that the collected developer in the collection conveyance path is adhered to the developer carrying member when the volume of the collected developer in the collection conveyance path reaches a certain level. The collection conveyance path conveys the collected developer from the upstream side to the downstream side thereof, and transfers the developer from the downstream side thereof to the agitation conveyance path. In the course of the transfer from the downstream side of the collection conveyance path to the agitation conveyance path, the developer conveyance direction of the collected developer shifts significantly. Consequently, the collected developer can be accumulated at the downstream side of the collection conveyance path, and the height of the collected developer can reach higher than a certain level. In this case, the collected developer in the collection conveyance path is re-supplied to the developer carrying member, resulting in an occurrence of a problem in that the collected developer having an inappropriate toner density (i.e., the toner is consumed) is mixed with the developer having an appropriate toner density. Thereby, the toner density can be decreased, and uneven images can be generated.

SUMMARY OF THE INVENTION

According to an aspect of the invention, a development device includes a developer carrying member, a developer supply conveyance path, a developer collection conveyance path, a developer agitation conveyance path, at least one partition member, at least one transfer opening, and a communication opening. The developer carrying member rotates while bearing thereon a two-component developer including a magnetic carrier and a toner. This developer carrying member supplies the toner to a latent image on a surface of a latent image carrier in a development region in which the developer carrying member faces the latent image carrier so as to develop the latent image. The developer supply conveyance path includes a developer supply conveyance member supplying the two-component developer to the developer carrying member so as to convey the two-component developer in a first direction of the developer carrying member. The developer collection conveyance path includes a developer collection conveyance member collecting a developer collected from the developer carrying member passed the opposing position so as to convey the collected developer in the first direction. The developer agitation conveyance path includes a developer agitation conveyance member receiving an excess developer unused for development and the collected developer. The developer agitation conveyance path conveys the excess developer and the collected developer in a second direction opposite to the first direction while agitating the developers, and supplies the agitated developers to the developer supply conveyance path. The at least one partition member separates the developer collection conveyance path, the developer supply conveyance path, and the developer agitation conveyance path from each other. The at least one transfer opening is disposed in the partition member to transfer the collected developer from an end of the developer collection conveyance path at a downstream side relative to the first direction to an upstream side of the developer agitation conveyance path relative to the second direction. The communication opening communicates the developer collection conveyance path with the developer agitation conveyance path. The communication opening is disposed at a further upstream side of the developer collection conveyance path than the at least one transfer opening relative to the first direction and at a higher position than a predetermined height of the developer collection conveyance path.

A process cartridge detachably installed in an image forming apparatus as a unit including a development device and at least one of a latent image carrying member, a charging device, and a cleaning device. The development device develops a latent image on the latent image carrying member. A charging device charges the latent image carrying member. The cleaning device cleans a surface of the latent image carrying member.

An image forming apparatus includes a latent image carrying member and a development device. The latent image carrying member carries a latent image, and the development device develops the latent image.

BRIEF DESCRIPTION OF THE DRAWINGS

A more complete appreciation of the exemplary aspects of the invention and many of the attendant advantage thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
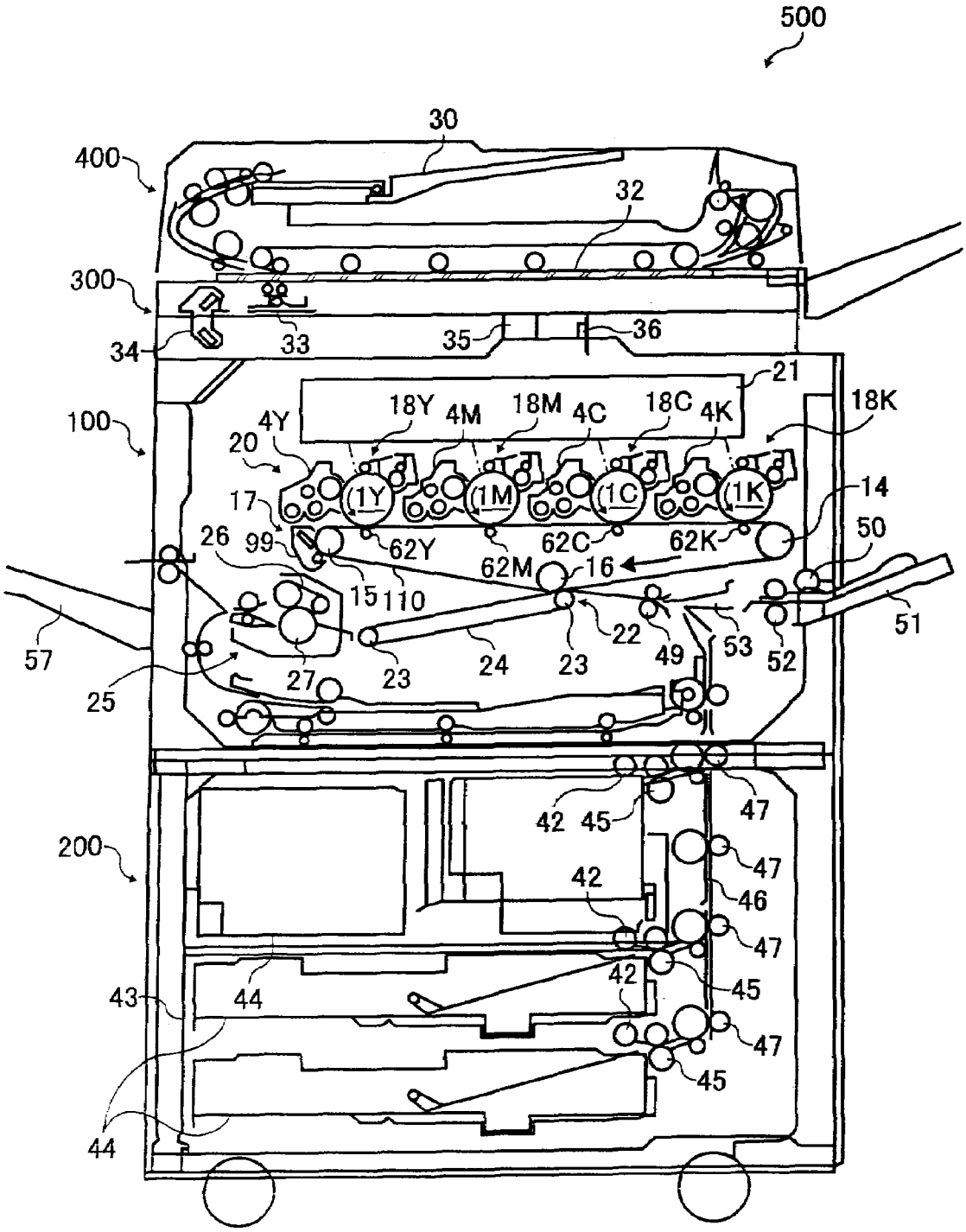
FIG. 1 is a schematic diagram illustrating an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an exemplary embodiment of the present invention is described.

Referring to FIG. 1, a tandem image forming apparatus 500 having four photoconductor drums 1Y, 1M, 1C and 1K for four colors is illustrated. The image forming apparatus 500 includes a printing unit 100, a sheet feeder 200, a scanner 300 and an automatic document feeder 400.

The printing unit 100 includes an optical writing unit 21, an image forming unit 20, an intermediate transfer unit 17, a secondary transfer device 22, a pair of registration rollers 49 and a fixing device 25.

The optical writing unit 21 includes an optical source (not shown), a polygon mirror (not shown), a fθ lens (not shown) and a reflection mirror (not shown). The optical writing unit 21 writes an electrostatic latent image, for example, on the photoconductor drum 1Y, with a laser beam that is formed based on image data. The description of the optical writing unit 21 will be explained later.

The image forming unit 20 includes four process cartridges 18Y, 18M, 18C and 18K for the four colors, yellow, magenta, cyan and black which are abbreviated as Y, M, C and K, respectively. The abbreviations may be omitted as necessary. The process cartridge 18Y is treated as representative of the process cartridges 18Y, 18M, 18C and 18K, and includes the photoconductor drum 1Y, a charging device (not shown), a development device 4Y, a drum cleaning device (not shown) and a discharger (not shown). As the process cartridges 18Y, 18M, 18C and 18K are substantially similar to one another except for the color of the toner, only the process cartridge 18Y will be explained.

The charging device of the process cartridge 18Y uniformly charges a surface of the photoconductor drum 1Y. The optical writing unit 21 modulates and deflects the laser beam to irradiate the surface of the photoconductor drum 1Y so that the potential of an irradiated area of the photoconductor drum 1Y decays, resulting in formation of an electrostatic latent image on the surface of the photoconductor drum 1Y. The development device 4Y develops the electrostatic latent image on the photoconductor drum 1Y with a developer including a yellow toner to form a yellow toner image Y.

The toner image Y on the photoconductor drum 1Y is primarily transferred onto an intermediate transfer belt 110 which will be described later. The drum cleaning device removes a remaining toner from the surface of the photoconductor drum 1Y. The discharger discharges the photoconductor drum 1Y. Thus, the photoconductor drum 1Y is initialized, and the charging device uniformly charges the photoconductor drum 1Y to form the next image. Similarly, the processes cartridges 18M, 18C and 18K execute the series of the image forming process such as charging, writing, developing, transferring, cleaning and discharging.

The intermediate transfer unit 17 includes the intermediate transfer belt 110, a belt cleaning device 99, a tension roller 14, a drive roller 15, a secondary backup roller 16 and primary transfer bias rollers 62Y, 62M, 62C and 62K.

The intermediate transfer belt 110 is tightly stretched by a plurality of rollers including the tension roller 14, and rotates clockwise with an endless movement. The drive roller 15 is driven by a belt driving motor (not shown) so as to drive the intermediate transfer belt 110 to rotate.

The primary transfer bias rollers 62Y, 62M, 62C and 62K are disposed in such a manner to contact an inner circumference side of the intermediate transfer belt 110 so as to receive a primary transfer bias applied thereto from a power source (not shown). The primary transfer bias rollers 62Y, 62M, 62C and 62K press the inner circumference side of the intermediate transfer belt 110 towards the photoconductor drums 1Y, 1M, 1C and 1K to form primary transfer nips. In each of the primary transfer nips, a primary transfer electric field generated by the primary transfer bias is generated. Specifically, the primary transfer electric field is formed between the photoconductors 1 and the respective primary transfer bias rollers 62.

The toner image Y formed on the photoconductor drum 1Y is primarily transferred onto the intermediate transfer belt 110 by the primary transfer electric field and nip pressure. Similarly, toner images M, C and K formed on respective photoconductors drums 1M, 1C and 1K are primarily transferred onto the intermediate transfer belt 110. In other words, a four-color image is formed on the intermediate transfer belt 110 while overlaid.

The four-color image on the intermediate transfer belt 110 is secondarily transferred onto a transfer sheet as a recording sheet (not shown) at a secondary transfer nip which will be described later. After the intermediate transfer belt 110 passes the secondary nip, the belt cleaning device 99 removes the remaining toner from the surface of the intermediate transfer belt 110.

The secondary transfer device 22 is disposed below the intermediate transfer unit 17, and includes a sheet conveyance belt 24 and secondary transfer tension rollers 23. The sheet conveyance belt 24 is tightly stretched by the secondary transfer tension rollers 23, and rotates counterclockwise with rotation of at least one of the secondary transfer tension rollers 23. One of the secondary transfer rotation rollers 23 disposed at a right hand side of FIG. 1 and the secondary transfer backup roller 16 sandwich the intermediate transfer belt 110 and the sheet conveyance belt 24 therebetween. In other words, the intermediate transfer belt 110 and the sheet conveyance belt 24 contact each other at the secondary transfer nip. The power source applies a secondary transfer bias having a polarity opposite to that of the charge of the toner to one of the secondary transfer tension rollers 23 disposed at the right hand side. Application of the secondary transfer bias forms a secondary transfer electric field in the secondary transfer nip. The secondary transfer electric field electrostatically transfers the four-color image on the intermediate transfer belt 110 towards the secondary transfer tension roller 23 at the right hand side of FIG. 1. The pair of registration rollers 49 register the transfer sheet to feed into the secondary transfer nip in such a manner to be synchronized with the four-color image on the intermediate transfer belt 110. The four-color image is secondary transferred onto the transfer sheet by the secondarily transfer electric field and nip pressure. The exemplary embodiment of the present invention employs the secondary transfer system to apply the secondary transfer bias to one of the secondary transfer tension rollers 23. However, a charger can be employed to charge the transfer sheet in a non-contact manner, substituting for the secondary transfer system.

The image forming apparatus 500 includes the sheet feeder 200 at a lower portion thereof as shown in FIG. 1. The sheet feeder 200 includes sheet cassettes 44, sheet feeding rollers 42, a feeding path 46, a sheet bank 43 and sheet separation rollers 45. Each of the sheet cassettes 44 stores a plurality of transfer sheets therein. The sheet cassettes 44 are disposed one above another in a vertical direction. Each of the sheet cassettes 44 presses an uppermost sheet against the corresponding sheet feeding roller 42, and the uppermost sheet is fed towards the feeding path 46 by rotation of the sheet feeding roller 42.

The feeding path 46 is a path in which the recording sheet is conveyed towards the registration rollers 49. The feeding path 46 includes a plurality of conveyance rollers 47 and the registration rollers 49 in a vicinity of the end portion thereof. When the four-color image on the intermediate transfer belt 110 is entered into the secondary transfer nip with an endless movement of the intermediate transfer belt 110, the pair of registration rollers 49 sandwich the transfer sheet therebetween and feed the transfer sheet at a desired timing to the four-color image on the intermediate transfer belt 110. The four-color image is adhered to the transfer sheet at the secondary transfer nip to be secondarily transferred, resulting in formation of a full color image on the transfer sheet. The transfer sheet with the full color image is fed out from the secondary transfer nip with rotation of the sheet conveyance belt 24, and is conveyed to the fixing device 25.

The fixing device 25 of the printing unit 100 includes a belt unit and a pressure roller 27. The belt unit includes a fixing belt 26 and two rollers. The fixing belt 26 is tightly stretched by the two rollers and rotates with endless movement. The pressure roller 27 presses one of the rollers. The fixing belt 26 and the pressure roller 27 contact each other so as to form a fixing nip in which the transfer sheet conveyed from the sheet conveyance belt 24 is nipped. One of the rollers pressed by the pressure roller 27 includes a heat source (not shown) therein to heat the fixing belt 26. The heated fixing belt 26 heats the transfer sheet nipped at the fixing nip. Therefore, the full color image is fixed onto the transfer sheet by the heat and nip pressure.

The fixing device 25 fixes the full color toner image on the transfer sheet, and the transfer sheet is stacked on a stacking area 57 disposed at a left hand side of the image forming apparatus 500. When a toner image is formed on another side of the transfer sheet, the transfer sheet is returned to the secondary transfer nip.

The image forming apparatus 500 includes the automatic document feeder 400 disposed above the scanner 300 as shown in FIG. 1. The automatic document feeder 400 includes an original table 30. When the image forming apparatus 500 is used to make a copy, for example, an original bunch is placed on the original table 30. However, when one side of an original is bound like a book, the automatic document feeder 400 is opened with respect to the image forming apparatus 500, and the original is placed on a contact glass 32 that is included in the scanner 300. This opening of the automatic document feeder 400 exposes the contact glass 32. The original on the contact glass 32 is held by closing the automatic document feeder 400.

The scanner 300 includes the contact glass 32, a first traveling body 33, a second traveling body 34, an imaging lens 35 and a reading sensor 36. The first traveling body 33 includes a light source (not shown), and the second traveling body includes a mirror (not shown).

The scanner 300 reads the original on the contact glass 32 by pressing a start switch (referring to as an original reading operation). When the original is placed on the original table 30, the original is automatically transferred to the contact glass 32 so as to be read by the scanner 300. During the original reading operation, the first and second traveling bodies 33 and 34 begin to travel, and the light source in the first traveling body 33 emits the light that is reflected from a surface of the original. The mirror in the second traveling body 34 reflects the light. The reflected light passes through the imaging lens 35 and enters into the reading sensor 36. The reading sensor 36 constructs image information based on the entered light.

In parallel with the original reading operation, each element in the process cartridges 18Y, 18M, 18C and 18K, the intermediate transfer unit 17, the secondary transfer device 22 and the fixing device 25 begin to drive. The optical writing unit 21 is controlled based on the image information constructed by the reading sensor 36, and the toner images Y, M, C and K are formed on the respective photoconductors 1Y, 1M, 1C and 1K. The toner images Y, M, C and K are superimposed and transferred onto the intermediate transfer belt 110 to form the four color toner image.

The sheet feeder 200 begins a feeding operation therewithin at substantially the same timing as the beginning of the original reading operation. In the feeding operation, one of the sheet feeding rollers is selected and rotated, and the transfer sheets are fed from one of the sheet cassettes 44 installed in the sheet bank 43. The sheet separation roller 45 separates the transfer sheets one by one so that each transfer sheet is entered into the feeding path 46 and is conveyed towards the secondary transfer nip by the conveyance rollers 47. The transfer sheets can be fed from a manual feeding tray 51 as well as the sheet cassettes 44. For example, a manual feeding roller 50 is selected and rotated to feed the transfer sheets on the manual feeding tray 51 into a separation roller 52. The separation roller 52 separates the transfer sheets one by one, and each separated transfer sheet is fed into a manual feeding path 53.

When the image forming apparatus 500 forms a multicolor image with at least two different toner colors, the intermediate transfer belt 110 is tightly stretched in such a manner that the upper stretch surface thereof becomes horizontal. In this regard, the photoconductors 1Y, 1M, 1C and 1K contact the stretched upper surface of the intermediate transfer belt 110. In contrast, when the image forming apparatus 500 forms a monochrome image with the black toner, the intermediate transfer belt 110 is positioned in such a manner as to incline towards lower left of FIG. 1 by using a mechanism (not shown). Thereby, the stretched upper surface of the intermediate transfer belt 110 is separated from the photoconductors 1Y, 1M and 1C. The photoconductor 1K rotates counterclockwise while contacting the stretched upper surface of the intermediate transfer belt 110 so that the toner image K is formed thereon. During the monochrome image formation, the photoconductors 1Y, 1M and 1C and the development devices 4Y, 4M and 4C halt, thereby reducing an occurrence of unnecessary consumption of the toner and wearing of the photoconductors.

The image forming apparatus 500 includes a control unit (not shown) and an operation display unit (not shown). The control unit includes a CPU, and the operation display unit includes a liquid crystal display and key buttons. For example, when a user keys in an input to the operation display unit, a command is sent to the control unit so that the user can select one of three one-sided print modes. The toner image is formed on one side of the transfer sheet by selecting one of the three one-sided print modes such as a direct ejection mode, a reverse ejection mode, and a reverse decor ejection mode.

Figure 2:
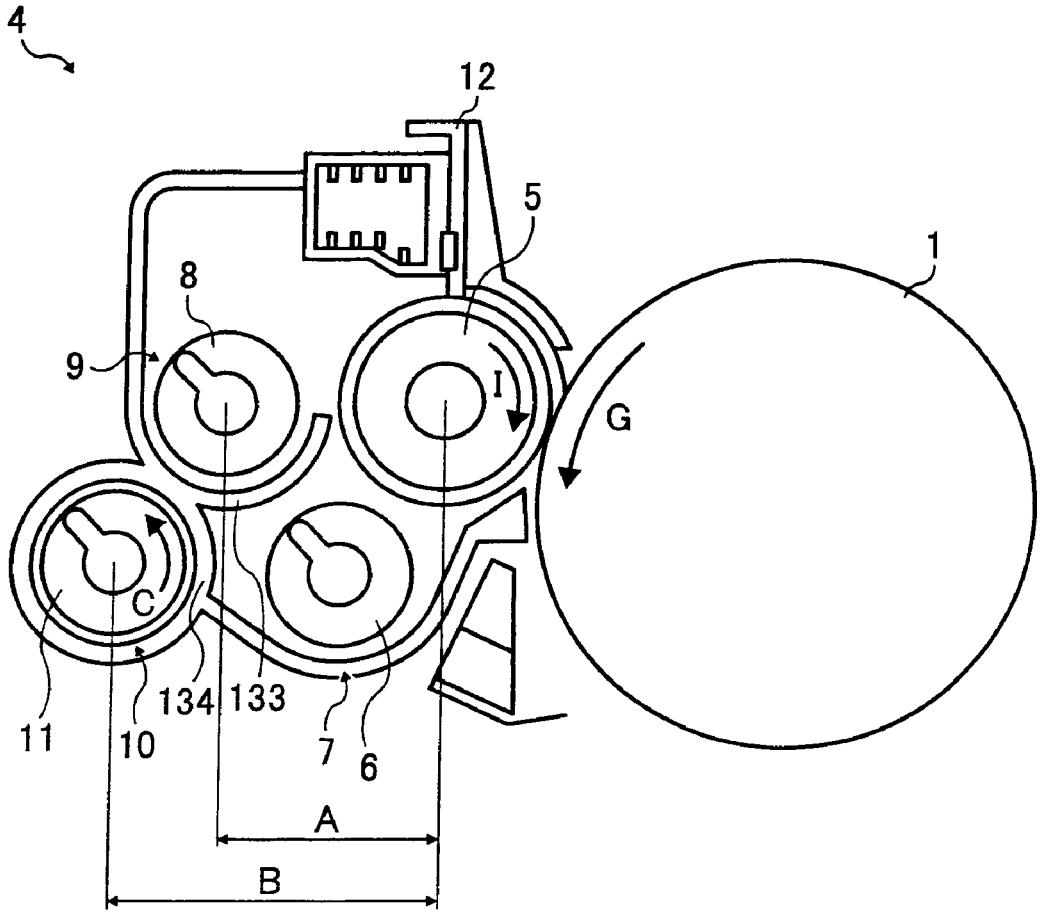
FIG. 2 is a schematic diagram illustrating a development device and a photoconductor of the image forming apparatus of FIG. 1.

Referring to FIG. 2, one of the photoconductors 1Y, 1M, 1C and 1K and one of the development devices 4Y, 4M, 4C and 4K included in one of the process cartridges 18Y, 18M, 18C and 18K of FIG. 1 are enlarged, as representatives of the photoconductors 1 and the development devices 4. The color abbreviations are omitted as necessary.

The photoconductor 1 rotates in a direction G, represented by an arrow shown in FIG. 2, to charge a surface thereof with the charging device (not shown). The surface of the photoconductor 1 is irradiated by the laser beam from the optical writing unit 21 of FIG. 1 so as to form the electrostatic latent image thereon. The development device 4 develops the electrostatic latent image with the toner to form the toner image.

The development device 4 includes a development roller 5, a supply screw 8, a development doctor 12, a collection screw 6, a supply conveyance path 9, a collection conveyance path 7, an agitation conveyance path 10, a first partition wall 133 and a second partition wall 134.

The development roller 5 serving as a developer carrying member supplies the toner to the electrostatic latent image on the surface of the photoconductor 1 while moving a surface thereof in a direction I, represented by an arrow shown in FIG. 2. The supply screw 8 serving as a developer supply conveyance member conveys the developer to a rear direction of FIG. 2 while supplying the developer to the development roller 5.

The development doctor 12 serving as a developer regulation member regulates a thickness of the developer supplied to the development roller 5 to be an appropriate level. The development doctor 12, made of for example, stainless steel, is located at a downstream side in a surface movement direction of the development roller 5 from a position substantially opposite to the supply screw 8 as shown in FIG. 2.

The collection screw 6 serving as a developer collection conveyance member collects the developer passed a development region and conveys the collected developer to a direction substantially the same as the supply screw 8. The collection screw 6 is located at the downstream side in the surface movement direction of the development roller 5 from a position of the development region substantially opposite to the photoconductor 1 as shown in FIG. 2. The supply conveyance path 9 serving as a developer supply conveyance path conveying the developer includes the supply screw 8, and is disposed at substantially the same elevation as the development roller 5. The collection conveyance path 7 serving as a developer collection conveyance path collecting the developer includes the collection screw 6, and is disposed below the development roller 5.

The agitation conveyance path 10 serving as a developer agitation conveyance path is disposed below the supply conveyance path 9 and side by side with the collection conveyance path 7. The agitation conveyance path 10 includes an agitation screw 11 that conveys the developer in an opposite direction to the supply screw 8 (towards a front side of FIG. 2) while agitating the developer as a developer agitation conveyance member.

The first partition wall 133 serving as a first partition member separates the supply conveyance path 9 from the agitation conveyance path 10 while including openings at a front side and a rear side thereof of FIG. 2. Thereby, the supply conveyance path 9 and the agitation conveyance path 10 are in communication with each other.

The first partition wall 133 also separates the supply conveyance path 9 from the collection conveyance path 7. However, the first partition wall 133 has substantially no opening between the supply conveyance path 9 and the collection conveyance path 7.

The second partition wall 134 serving as a second partition member separates the agitation conveyance path 10 from the collection conveyance path 7. The second partition wall 134 includes an opening in a front side thereof of FIG. 2 so that the agitation conveyance path 10 and the collection conveyance path 7 are in communication with each other. The second partition wall 134 includes a communication opening 94 (shown in FIG. 3).

Each of the supply screw 8, collection screw 6 and agitation screw 11 includes resin with a diameter of 18 mm, a screw pitch of 25 mm, and an approximate rotation speed of 600 rpm.

The development roller 5 includes the developer regulated by the development doctor 12 to be a thin layer thereon. The thin layer developer is conveyed to the development region positioned opposite to the photoconductor 1 for the development. The surface of the development roller 5 can include a V-groove or can be sandblasted. The development roller 5 includes an aluminum tube with a diameter of 25 mm. The developer roller 5 and the developer doctor 12 include a gap therebetween, and the developer roller 5 and the photoconductor 1 include another gap therebetween. Each of the gaps can be approximately 0.3 mm.

After the development, the collection conveyance path 7 collects the developer and conveys to the front side of FIG. 2. The developer is transferred to the agitation conveyance path 10 at the opening of the first partition wall 133. The opening is disposed in a non-image area. The agitation conveyance path 10 includes a toner supply opening (not shown) thereabove in a vicinity of the opening of the first partition wall 133 at the upstream side in the developer conveyance direction thereof. Accordingly, the toner is supplied to the agitation conveyance path 10 from the toner supply opening.

Figure 3:
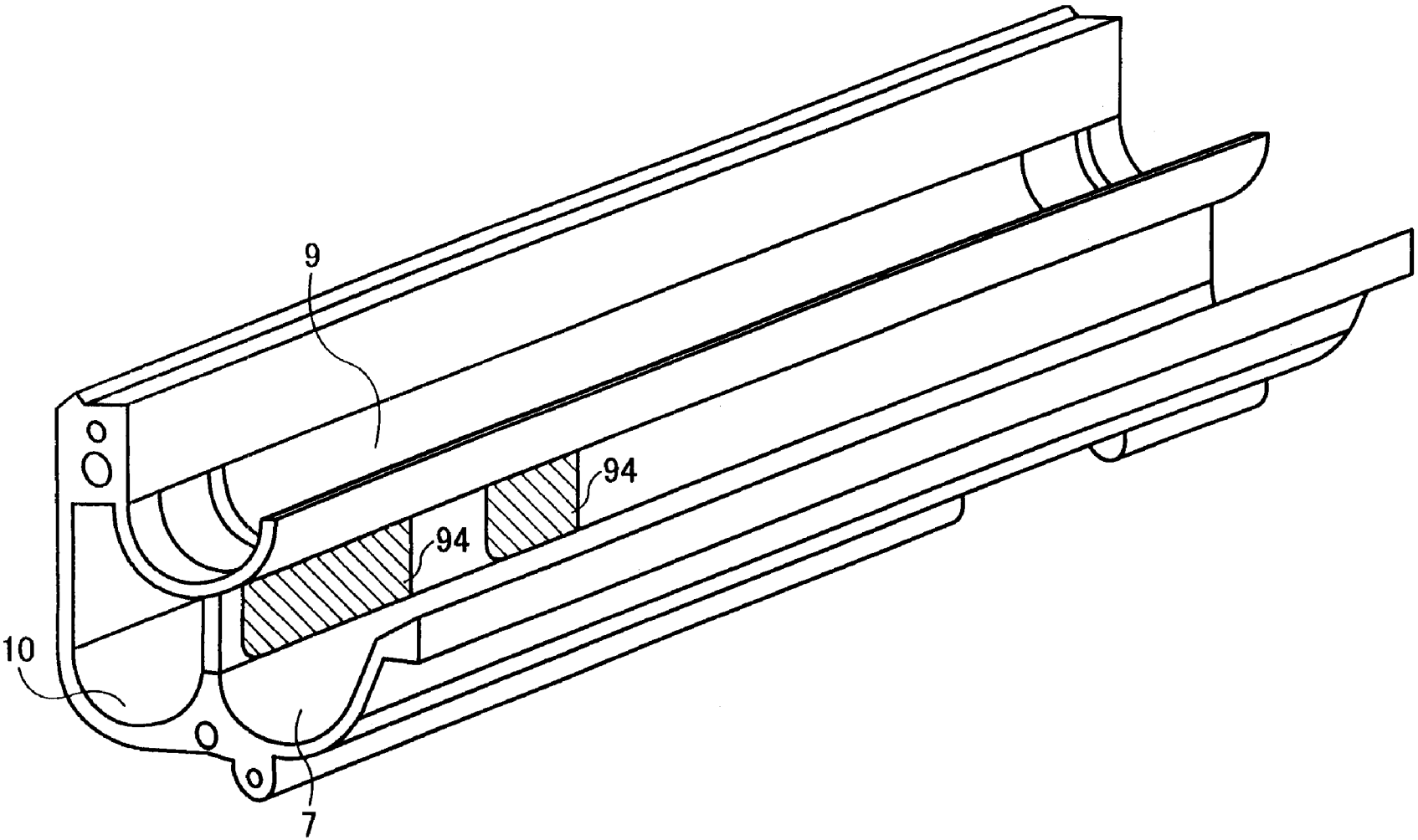
FIG. 3 is a schematic perspective view illustrating the development device of FIG. 2 with an opening through which a developer is transferred.

Referring to FIG. 3, the communication opening 94 of the second partition wall 134 is illustrated. As stated above in the description of FIG. 2, the second partition wall 134 includes the opening in the front side thereof. The communication opening 94 is disposed at a further upstream side than the opening in the developer conveyance direction of the collection conveyance path 7, and is positioned higher than a predetermined height (i.e., volume) of the collected developer conveyed by the collection conveyance path 7. Therefore, the collected developer conveyed by the collection conveyance path 7 can reduce the increase in volume, and reduce an occurrence of higher volume than the predetermined volume. By using the communication opening 94, the collection conveyance path 7 and the agitation conveyance path 10 are in communication with each other.

Figure 4:
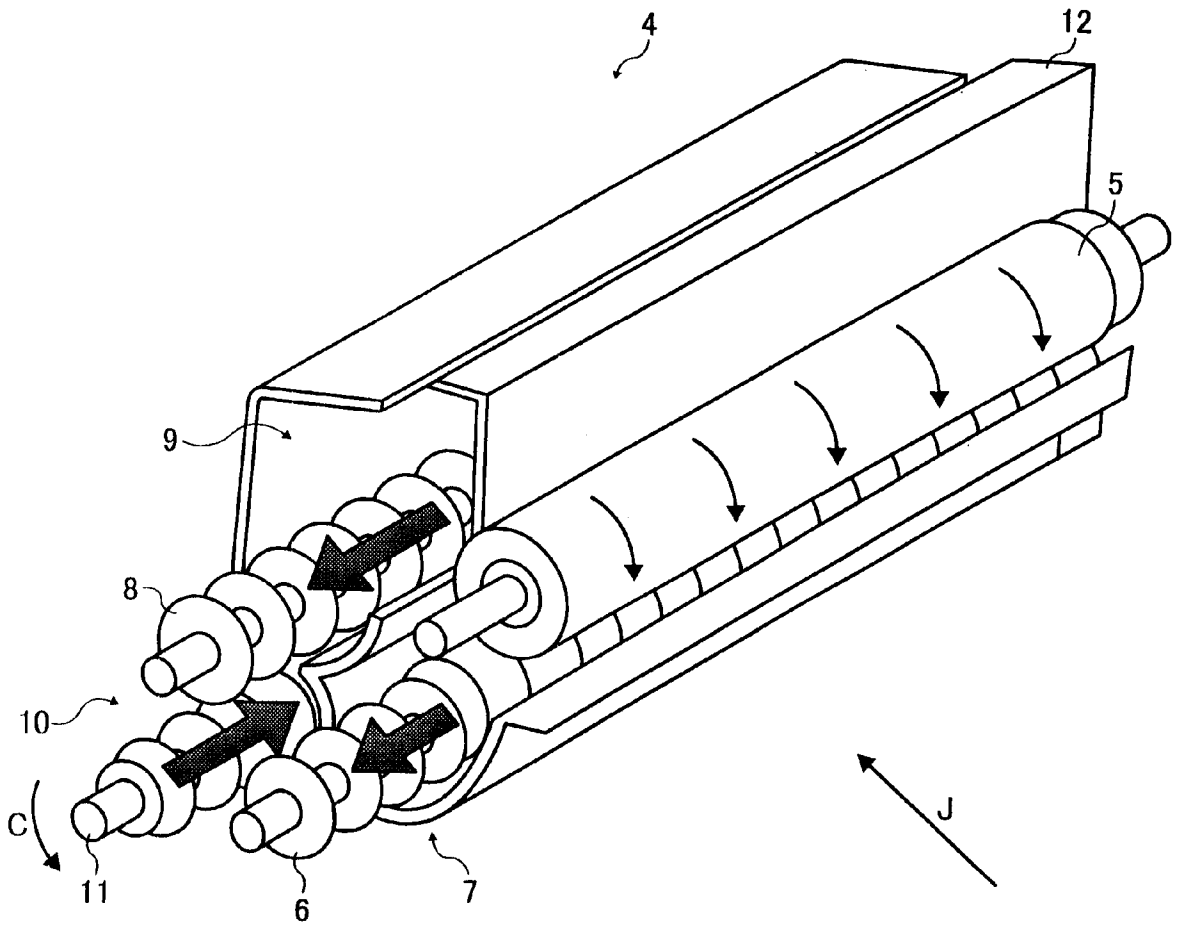
FIG. 4 is a schematic perspective view illustrating flow of a developer in the development device of FIG. 2.

FIG. 4 is a schematic perspective view illustrating flow of the developer in the development device 4. Each arrow in FIG. 4 represents a movement direction of the developer.

Figure 5:
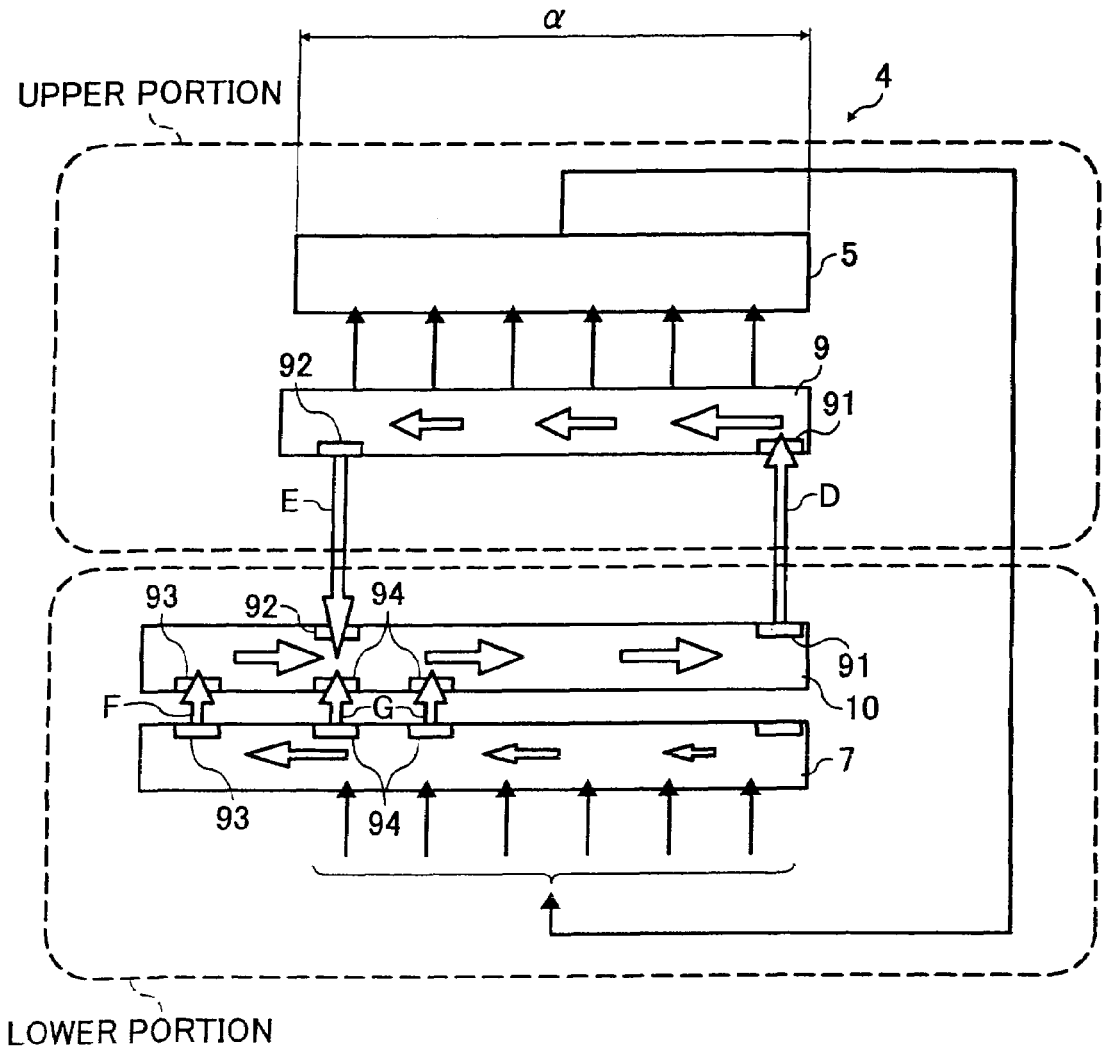
FIG. 5 is a schematic diagram illustrating the flow of the developer in the development device of FIG. 2.

FIG. 5 is a schematic diagram illustrating the flow of the developer in the development device 4. Each arrow in FIG. 5 represents the movement direction of the developer.

The agitation conveyance path 10 supplies the developer to the supply conveyance 9. The supply conveyance path 9 conveys the developer to the downstream side of the supply screw 8 relative to the developer conveyance direction while supplying the developer to the development roller 5. The first partition wall 133 includes an excess developer opening 92 through which an excess developer is supplied to the agitation conveyance path 10. The excess developer may represent a developer that is supplied to the development roller 5, but unused for the development. The excess developer is conveyed to the downstream end of the supply conveyance path 9 relative to the developer conveyance direction, and is supplied through the excess developer opening 92 to the agitation conveyance path 10, represented by an arrow E in FIG. 5.

The second partition wall 134 includes a collection developer opening 93. The collected developer is transferred from the developer 5 to the collection conveyance path 7, and is conveyed to the downstream end of the collection conveyance path 7 relative to the developer conveyance direction by the collection screw 6. The collected developer is supplied to the agitation conveyance path 10 through the collection developer opening 93, indicated by an arrow F in FIG. 5. When the collected developer is supplied from the downstream side of the collection conveyance path 7 to the agitation conveyance path 10, the collected developer can be accumulated at the downstream side in the collection conveyance path 7 due to a formation of the developer conveyance direction that is shifted at a substantially right angle. For example, when the collection conveyance path 7 collects a large volume of the collected developer, the volume of the collected developer can be higher than the predetermined volume at the downstream side of the collection conveyance path 7. A volume of the collected developer that is higher than the predetermined level (e.g., an excess volume) is supplied to the agitation conveyance path 10 from the collection conveyance path 7 through the communication opening 94, indicated by an arrow G in FIG. 5. Therefore, the collected developer can reduce the increase in volume, and reduce an occurrence of a higher volume than the predetermined volume. By using the communication opening 94, the volume of the collected developer of the collection conveyance path 7 is regulated, thereby reducing the movement of the collected developer of the collection conveyance path 7 to the developer carrying member. In an exemplary embodiment, the communication opening 94 is disposed at the downstream side of the collection conveyance path 7 so as to deal with the volume of the accumulated collected developer. However, the communication opening 94 can be disposed at another position in the partition wall as long as the likelihood of the collected developer movement to the development roller 5 can be reduced. The communication opening 94 can be disposed in an upstream side of the collection conveyance path 7, for example, when the development device 4 has a likelihood of including the excess volume of the collected developer at the upstream side of the collection conveyance path 7. Consequently, the likelihood of the collected developer movement to the development roller 5 can be reduced at the upstream side. Therefore, the communication opening 94 can be disposed at an appropriate position according to the configuration of the development device 4 to reduce an occurrence of the collected developer movement of the collection conveyance path 7 to the developer roller 5. The communication opening 94 can include a plurality of openings in a plurality of locations as illustrated in FIG. 5. However, the communication opening 94 can include an opening in a location.

The first separation wall 133 includes a supply opening 91. The agitation conveyance path 10 agitates the excess developer and the collected developer to convey towards the downstream side of the agitation screw 11 in the developer conveyance direction and the upstream side of the supply screw 8 in the developer conveyance direction. Accordingly, the agitated developer is supplied to the supply conveyance path 9 through the supply opening 91, represented by an arrow D in FIG. 5.

In the agitation conveyance path 10, the agitation screw 11 agitates the collected developer, the excess developer and a supply toner, and conveys in a direction opposite to the developer of the collection conveyance path 7 and the supply conveyance path 9. The supply toner is toner that is supplied at a transfer area as may be necessary. The agitation screw 11 transfers the agitated developer to the upstream side of the supply conveyance path 9 relative to the developer conveyance direction of which the downstream side relative to the developer conveyance direction is communicated. The agitation conveyance path 10 includes a toner density sensor (not shown) therebelow. The toner density sensor outputs a sensor to operate a toner supply control unit (not shown) to supply the toner from a toner container (not shown).

As shown in FIG. 5, the development device 4 includes the supply conveyance path 9 and the collection conveyance path 7 so that the developer is supplied and collected separately. In this way, the developer used for the development (i.e., the developer after the development) cannot be mixed in the supply conveyance path 9. The toner density of the developer supplied to the development roller 5 can reduce a deterioration occurrence as closer to the downstream side of the supply conveyance path 9 relative to the developer conveyance direction. Therefore, the toner density of the developer in the supply conveyance path 9 can reduce the deterioration occurrence, and an image density during the development can remain substantially constant.

As shown in FIG. 5, the arrow D represents a movement of the developer from a lower portion to an upper portion of the development device 4. When the agitation screw 11 rotates, the developer from the lower portion is forced to be lifted and supplied to the supply conveyance path 9.

However, such movements can place stress on the developer, and the lifespan of the developer can be shortened.

For example, when stress is placed on the developer due to the developer moving from the lower portion to the upper portion of the development device 4, a cover layer of the carrier in the development can be abraded, or the carrier can deteriorate chargeability thereof due to adhesion of the toner thereto in a stress area, causing deterioration of the image quality.

In other words, the developer can extend the lifespan thereof by reducing the stress placed by the movement of the developer indicated by the arrow D. The reduction of stress will be described later. Extending the lifespan of the developer can reduce deterioration of the developer. Thereby, the development device 4 can provide a quality image while reducing unevenness in image density.

In the development device 4 of the exemplary embodiment as shown in FIG. 2, the supply conveyance path 9 is disposed in such a manner to be obliquely above the agitation conveyance path 10 compared to a situation in which the conveyance path 9 is disposed above the agitation conveyance path 10. Therefore, the stress placed on the developer indicated by the arrow D in FIG. 5 can be reduced.

As the supply conveyance path 9 is disposed obliquely above the agitation conveyance path 10, an upper wall surface of the agitation conveyance path 10 is positioned higher than a lower wall surface of the supply conveyance path 9 as shown in FIG. 2.

For example, when the developer in the agitation conveyance path 10 is vertically lifted to the supply conveyance path 9, the agitation screw 11 applies pressure to lift the developer. In other words, the agitation screw 11 works against gravity, resulting in placing stress on the developer. In contrast, when the upper wall surface of the agitation conveyance path 10 is positioned higher than the lower wall surface of the supply conveyance path 9, the developer in substantially the highest point of the agitation conveyance path 10 is transferred to substantially the lowest point of the supply conveyance path 9 by using gravity. Therefore, stress placed on the developer can be reduced.

The agitation screw 11 at the downstream side of the developer conveyance path of the agitation conveyance path 10 at which the agitation conveyance path 10 and the supply conveyance path 9 communicate with each other and can include a fin in an axis thereof. The fin can be a plate member, and can include a side parallel to an axis direction of the agitation screw 11 and another side perpendicular to the axis direction of the agitation screw 11. The fin can scoop up developer so as to increase the transfer efficiency of developer from the agitation conveyance path 10 to the supply conveyance path 9.

As shown in FIG. 2, the development device 4 has a center-to-center distance A between the development roller 5 and the supply conveyance path 9, and a center-to-center distance B between the development roller 5 and the agitation conveyance path 10. The supply conveyance path 9 and the agitation conveyance path 10 are disposed such that the center-to-center distance A is shorter than the center-to-center distance B. Thereby, the development device 4 can supply developer from the supply conveyance path 9 to the developer roller 5 reasonably, and the development device 4 can be downsized.

The agitation screw 11 of FIG. 2 rotates counterclockwise as indicated by an arrow C to lift the developer along the shape thereof and transfer the developer to the supply conveyance path 9. Accordingly, the agitation screw 11 can efficiently lift the developer and reduce the amount of stress placed on the developer.

Figure 6:
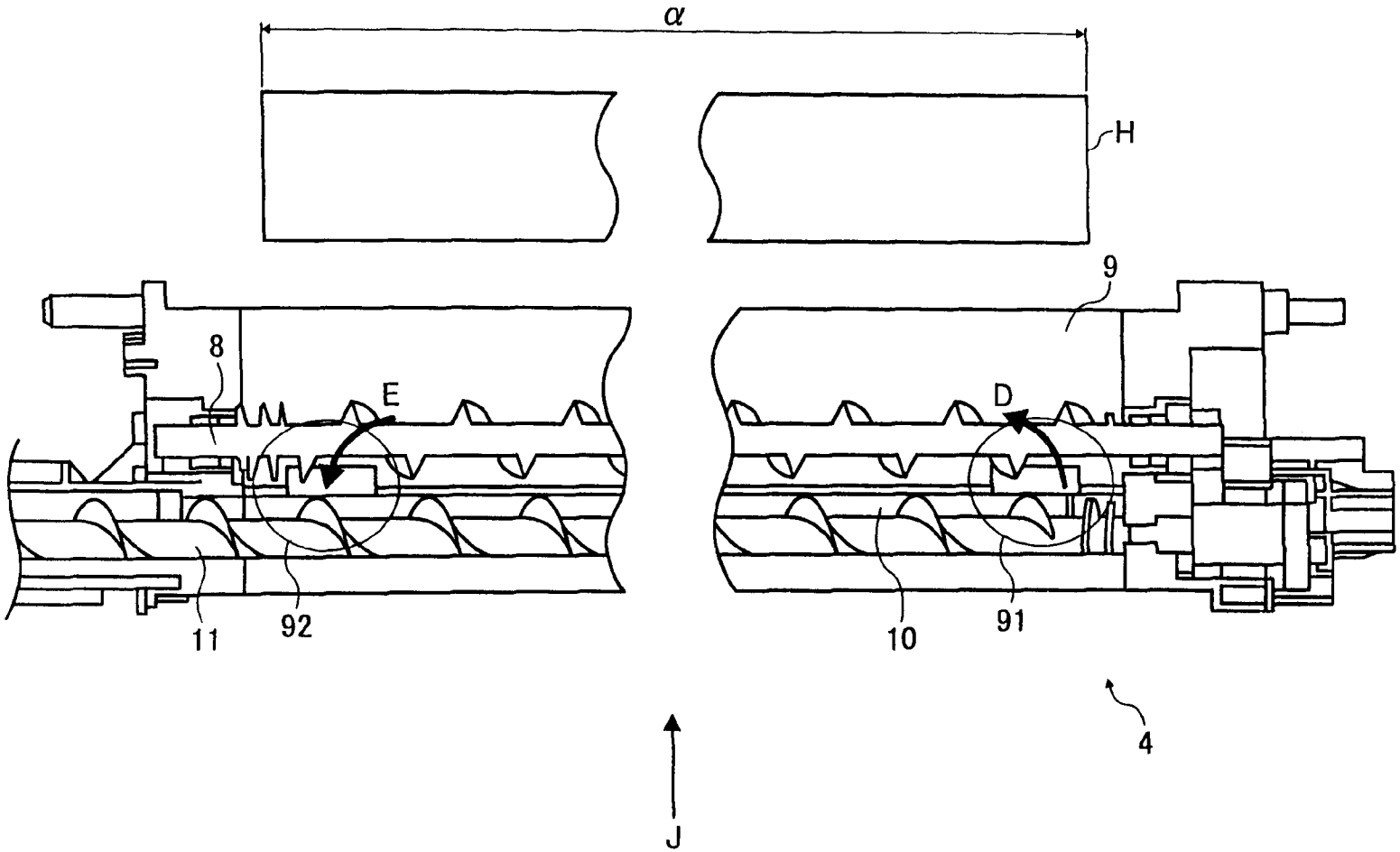
FIG. 6 is a schematic view illustrating the development device of FIG. 2.

FIG. 6 is a cross section illustrating a rotational center of the supply screw 8 of the development device 4 when observed as seen from an arrow J of FIG. 4. A development region H is a region in which the development roller 5 supplies toner to the photoconductor 1. The development region H includes a development region $\alpha$ that is a width in an axis line direction of the rotational axis of the development roller 5.

As shown in FIG. 6, the development device 4 includes the supply opening 91 through which developer is lifted to the supply conveyance path 9 from the agitation conveyance path 10, and the excess developer opening 92 through which developer is supplied to the agitation conveyance path 10 from the supply conveyance path 9 within the development region $\alpha$.

Figure 7:
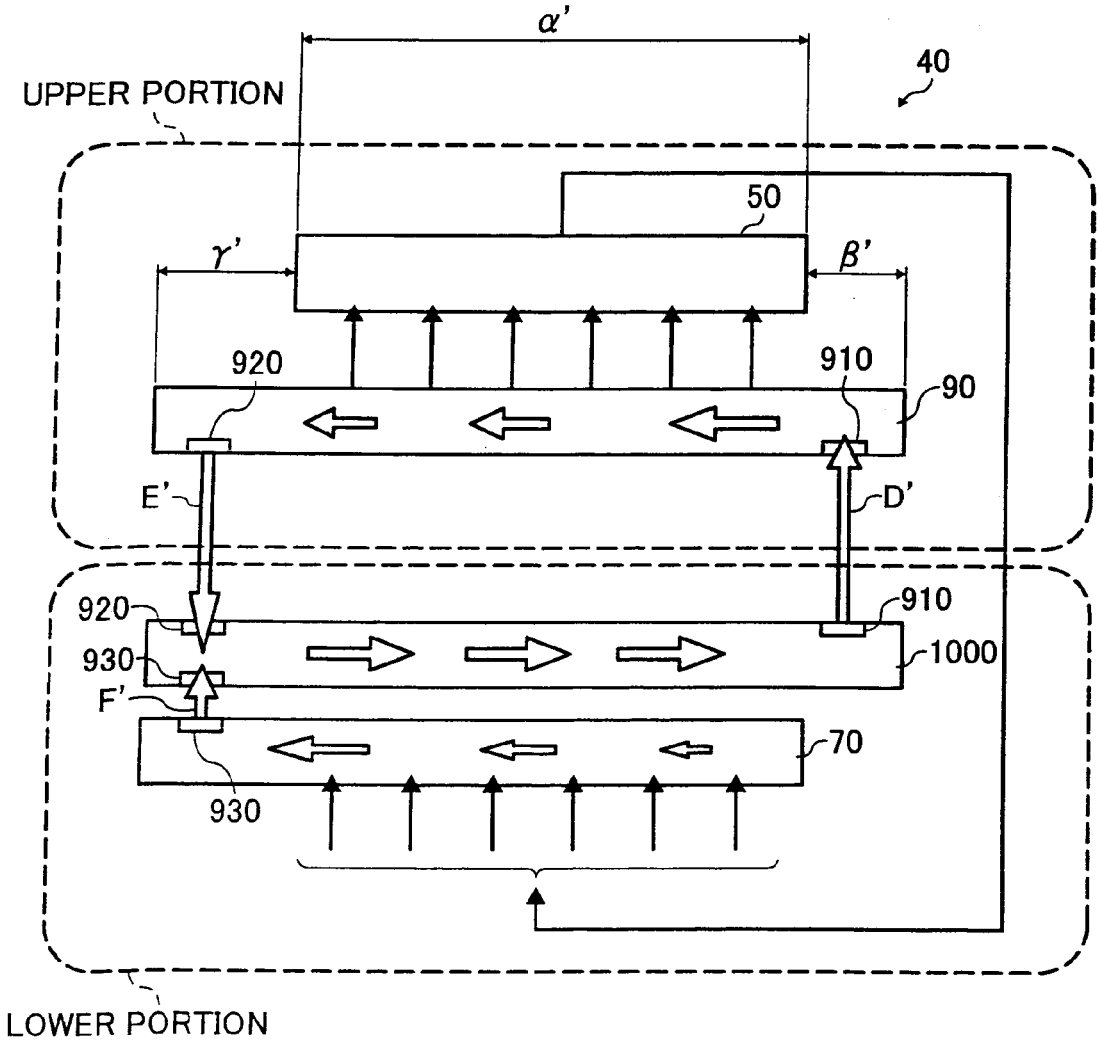
FIG. 7 BACKGROUND ART
FIG. 7 is a schematic diagram illustrating flow of a developer in a background development device.

Referring to FIG. 7, a background development device 40 illustrates the flow of developer. The development device 40 includes a supply opening 910 and an excess developer opening 920 located outside a development region $\alpha'$. As the supply opening 910 is disposed outside the development region $\alpha'$, a supply conveyance path 90 at an upstream side in a developer conveyance direction is longer than a development roller 50 by an amount $\beta'$. As the excess developer opening 920 is disposed outside the development region $\alpha'$, the supply conveyance path 90, at a downstream side in the developer conveyance direction, is longer than the development roller 50 by an amount γ'. β' and γ' are respectively referred to as a supply conveyance path upstream side region and a supply conveyance path downstream side region.

The development device 40 includes a plurality of development elements such as an agitation conveyance path 1000, a collection opening 930, and a collection conveyance path 70. These elements may be similar to the agitation conveyance path 10, the collection opening 93, and the collection conveyance path 7 of FIG. 5, respectively. In FIG. 7, arrows D', E' and F' represent the movement of developer, and these arrows may be similar to arrows D, E and F in FIG. 5.

Compared to development device 40 of FIG. 7, the supply opening 91 of development device 4 of the exemplary embodiment in FIG. 5 is disposed within the development region α, and the supply conveyance path 9 at the upstream side in the developer conveyance direction can be shorter than the development device 40 of FIG. 7 in an amount of β'. As the excess developer opening 92 is disposed within the development region α in FIG. 5, the supply conveyance path 9 at the downstream side in the developer conveyance direction can be shorter than the development device 40 of FIG. 7 in an amount of γ'.

Therefore, the development device 4 of the exemplary embodiment having the supply opening 91 and the excess developer opening 92 within development region α can downsize an upper portion thereof.

As shown in FIG. 5, the communication opening 94 is disposed in the collection conveyance path 7 within the development region α. In this way, the volume of developer can be reduced within the development region α, thereby reducing the possibility of a higher volume than the predetermined volume. Accordingly, the collected developer of the collection conveyance path 7 supplied to the development region H can be reduced. In other words, the developer supplied to the development region H cannot mix with the developer having low toner density, thereby reducing uneven image density during development.

Figure 8:
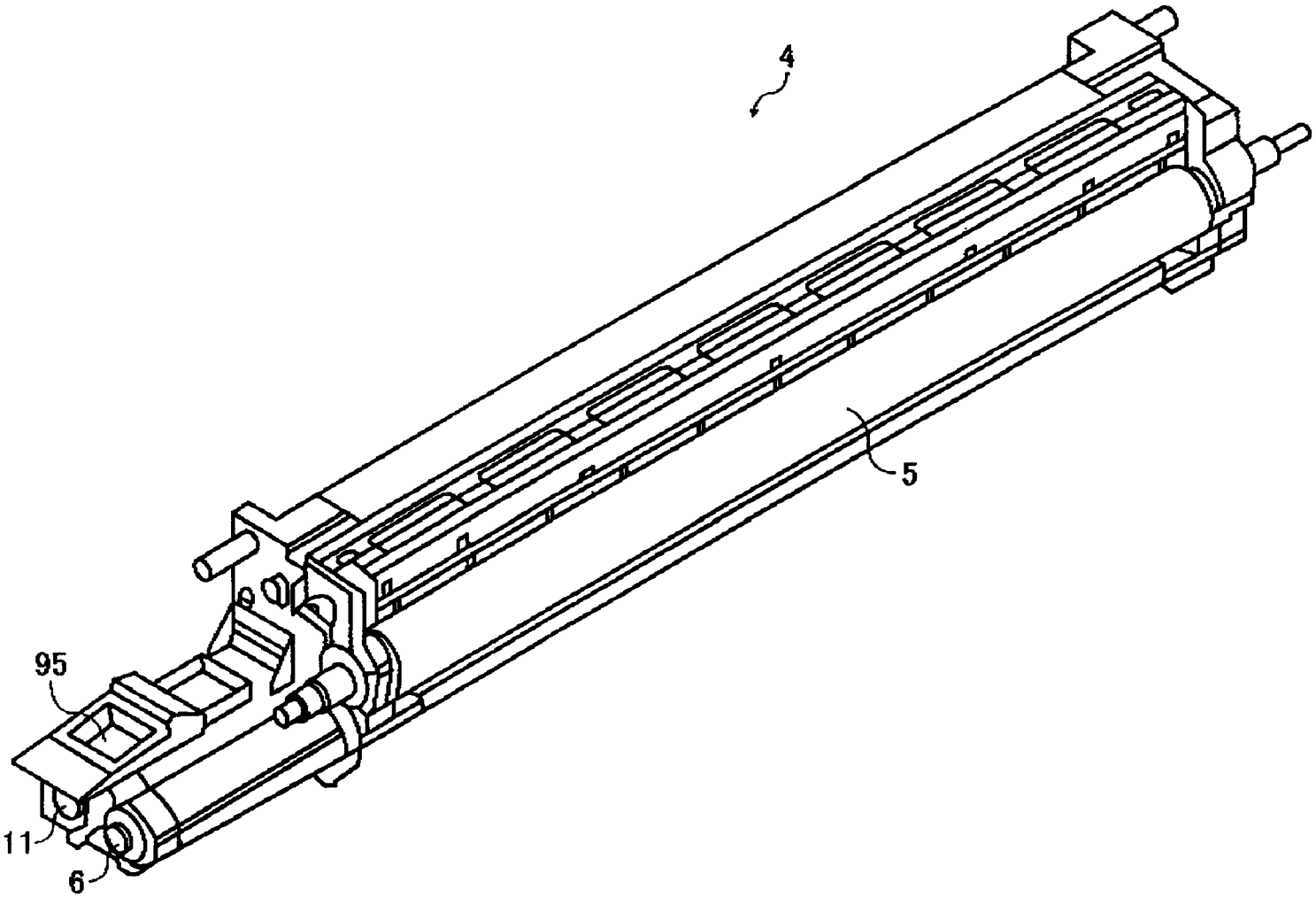
FIG. 8 is a perspective view illustrating a toner supply opening of the development device of FIG. 2.

Referring to FIG. 8, a toner supply opening 95 of the development device 4 of an exemplary embodiment is illustrated in a schematic perspective view.

The toner supply opening 95 is disposed above an end of the upstream side of the agitation conveyance path 10 relative to the developer conveyance direction, and supplies toner therethrough. The toner supply opening 95 is disposed outside an end of the development roller 5, along the axial direction of the development roller 5, thereby positioning the toner supply opening 95 outside the development region α of FIG. 5.

The toner supply opening 95 is positioned on an extended line in the developer conveyance direction of the supply conveyance path 9. The space where the toner supply opening 95 is positioned substantially corresponds to the supply conveyance path downstream side region γ' of FIG. 7. The excess developer opening 92 is disposed within the development region so that the space is generated to dispose the toner supply opening 95 therein, and thereby, the development device 4 can be downsized.

The toner supply opening 95 is disposed above the end of the upstream side of the agitation conveyance path 10 relative to the developer conveyance direction. However, the toner supply opening 95 can be disposed above an end of the downstream side of the collection conveyance path 7.

The toner supply opening 95 can also be disposed over the collection developer opening 93 through which the developer is supplied from the collection conveyance path 7 to the agitation conveyance path 10. As the excess developer opening 92 is disposed within the development region α, a space is generated over the collection developer opening 93. The toner supply opening 95 can be disposed in the space so that the development device 4 can be downsized. The collection developer opening 93 is an opening member at which the developer can be mixed more easily. Therefore, developer is supplied to the collection developer opening 93 to be agitated efficiently.

According to the development device 4 of an exemplary embodiment, the supply conveyance path 9 is disposed above the agitation conveyance path 10 and the collection conveyance path 7. However, the development device 4 of an exemplary embodiment is not limited to the description above, and can be applied to a development device having a supply conveyance path, agitation conveyance path and a collection conveyance path disposed at substantially the same elevation. When the collection conveyance path 7 and the agitation conveyance 10 are arranged so as to not be in contact with each other, a developer transfer path can be disposed to communicate the communication opening 94 at a side of the collection conveyance path 7 and the communication opening 94 at a side of the agitation conveyance path 10. Thereby, the excess volume of the collected developer can be conveyed to the agitation conveyance path 10 from the collection conveyance path 7.

According to an exemplary embodiment of the invention, the image forming apparatus 500 includes the process cartridge 18 detachable thereto. The process cartridge 18 includes the development device 4 including the development roller 5, supply conveyance path 9, collection conveyance path 7, and the agitation conveyance path 10. The development roller 5 rotates with the two-component developer having the magnetic carrier and the toner on a surface thereof, and supplies the toner to the electrostatic latent image on the surface of the photoconductor 1 at a position opposite to the photoconductor 1 so as to develop the image. The supply conveyance path 9 includes the supply screw 8 supplying the two-component developer to the development roller 5 so as to convey the two-component developer along the axis line direction of the development roller 5. The collection conveyance path 7 includes the collection screw 6 collecting developer passed to a position opposite to the photoconductor 1 from the development roller 5. The collection screw 6 conveys the collected developer along the axis line direction of the development roller 5. The agitation conveyance path 10 includes the agitation screw 11, and supplies the agitated developer to the supply conveyance path 9. The agitation screw 11 conveys the excess developer and collected developer along the axis line direction of the development roller 5 while agitating these developers. Each of the collection conveyance path 7, supply conveyance path 9 and agitation conveyance path 10 is separated from one another by a partition wall. The second partition wall 134 separates the collection conveyance path 7 from the agitation conveyance path 10, and includes the collection developer opening 93. The second partition wall 134 includes the communication opening 94 at the upstream side of the collection conveyance path 7 relative to the developer conveyance direction and at a position higher than the predetermined height of the collection conveyance path 7.

Therefore, when the volume of the collected developer becomes excessive at the collection conveyance path 7, the excess volume is transferred to the agitation conveyance path 10 from the collection conveyance path 7. Thereby, the collected developer within the collection conveyance path 7 can reduce the increase in volume so as to reduce the frequency in which the volume is higher than the predetermined volume.

The collected developer of the collection conveyance path 7 can reduce the movement thereof to the development roller 5. Thereby, the collected developer in which the unused toner and the developer to be supplied to the developer roller 5 are not mixed. Consequently, uneven image density during development can be reduced.

According to an exemplary embodiment, the second partition wall 134 is disposed within the development region α in the axis line direction of the development roller 5 of the development region H, and the communication opening 94 is disposed in the second partition wall 134.

Accordingly, the volume of the collected developer at the collection conveyance path 7 within the development region α can reduce the frequency in which there is an increase in amount higher than the predetermined volume. The collected developer of the collection conveyance path 7 can reduce the movement thereof to the development region H of the development roller 5. The developer having a low toner density can not mix with the developer to be supplied to the developer region H. Thereby, the uneven image density during the development can be reduced.

According to an exemplary embodiment, the supply conveyance path 9 and the agitation conveyance path 10 communicate with each other through the excess developer opening 92 supplying the excess developer from the downstream side of the supply conveyance path 9 relative to the developer conveyance direction to the upstream side of the agitation conveyance path 10 relative to the developer conveyance direction. The agitation conveyance path 10 and the supply conveyance path 9 communicate with each other through the supply opening 91 supplying the agitated developer from the downstream side the agitation conveyance path 10 relative to the developer conveyance direction to the upstream side of the supply conveyance path 9 relative to the developer conveyance direction. At least one of the excess developer opening 92 and the supply opening 91 is disposed in the first partition wall 133 within the development region α. Thereby, space for the supply conveyance path 9 can be saved, and the development device 4 can be downsized. Downsizing the development device 4 can save space within the process cartridge 18. In other words, the process cartridge 18 can also be downsized. The image forming apparatus 500 can include the development device 4 of an exemplary embodiment and the process cartridge 18 so as to save a space therewithin.

Numerous additional modifications and variations are possible in light of the above teachings. It is therefore to be understood that within the scope of the appended claims, the disclosure of this patent specification may be practiced otherwise than as specifically described herein.

What is claimed is:

1. A development device, comprising:

a developer carrying member configured to rotate while bearing thereon a two-component developer including a magnetic carrier and a toner, and configured to supply the toner to a latent image on a surface of a latent image carrier in a development region, in which the developer carrying member faces the latent image carrier;

a developer supply conveyance path including a developer supply conveyance member supplying the two-component developer to the developer carrying member and not receiving the two-component developer from the developer carrying member, the developer supply conveyance path conveying the two-component developer in a first direction; and a developer collection conveyance path including a developer collection conveyance member configured to collect a developer from the developer carrying member after the developer is passed through the development region, and conveying the collected developer in the first direction; and a developer agitation conveyance path including a developer agitation conveyance member configured to receive an excess developer unused for development and the collected developer and configured to convey the excess developer and the collected developer in a second direction opposite to the first direction while agitating the developers, the developer agitation conveyance path supplying the agitated developers to the developer supply conveyance path.

2. The development device of claim 1 further comprising:

at least one partition member configured to separate the developer collection conveyance path, the developer supply conveyance path, and the developer agitation conveyance path.

3. The development device of claim 1 wherein the developer agitation conveyance path includes a toner density sensor.

4. The development device of claim 3 wherein the toner density sensor is configured to notify a toner supply control unit to supply toner.

5. The development device of claim 2 further comprising:

at least one transfer opening disposed in the at least one partition member, the at least one transfer opening configured to transfer the collected developer from an end of the developer collection conveyance path at a downstream side relative to the first direction to an upstream side of the developer agitation conveyance path relative to the second direction.

6. The development device of claim 5 further comprising:

an opening configured to expose the developer collection conveyance path to the developer agitation conveyance path, and configured to be disposed in the developer collection conveyance path at a position further upstream than the at least one transfer opening relative to the first direction and located at a position higher than a predetermined height of developer in the collection conveyance path.

7. The development device of claim 6, wherein the opening is configured to be disposed in the at least one partition member so as to face the development region.

8. The development device of claim 6 further comprising:

a second opening configured to expose the developer supply conveyance path to the developer agitation conveyance path to transfer excess developer from the downstream side of the developer supply conveyance path relative to the first direction to the upstream side of the developer agitation conveyance path relative to the second direction; and a third opening configured to expose the developer agitation conveyance path to the developer supply conveyance path to transfer the agitated developer from a downstream side of the developer agitation conveyance path relative to the second direction to an upstream side of the developer supply conveyance path relative to the first direction, wherein at least one of the second communication opening and the third communication opening is disposed in the at least one partition member.

9. The development device of claim 2 wherein the at least one partition member is two partition members.

10. The development device of claim 9 wherein the development device contains a first partition member configured to separate the developer supply conveyance path from the developer agitation conveyance path and a second partition member configured to separate the developer agitation conveyance path from the developer collection conveyance path.

11. The development device of claim 10 wherein the first partition member is also configured to separate the developer supply conveyance path from the developer collection conveyance path.

12. The development device of claim 10 wherein the developer agitation conveyance path includes a toner supply opening.

13. The development device of claim 12 wherein the toner supply opening is located close to a opening of the first partition member at an upstream side of the conveyance of developer.

14. The development device of claim 10 wherein the first partition member does not contain an opening between the developer supply conveyance path and the developer collection conveyance path.

15. A process cartridge detachably installed in an image forming apparatus, the process cartridge, comprising:

a development device configured to develop a latent image on a latent image carrying member including, a developer carrying member configured to rotate while bearing thereon a two-component developer including a magnetic carrier and a toner, and configured to supply the toner to a latent image on a surface of a latent image carrier in a development region, in which the developer carrying member faces the latent image carrier, a developer supply conveyance path including a developer supply conveyance member supplying the two-component developer to the developer carrying member and not receiving the two-component developer from the developer carrying member, the developer supply conveyance path conveying the two-component developer in a first direction, a developer collection conveyance path including a developer collection conveyance member configured to collect a developer from the developer carrying member after the developer is passed through the development region, and conveying the collected developer in the first direction, and a developer agitation conveyance path including a developer agitation conveyance member configured to receive an excess developer unused for development and the collected developer and configured to convey the excess developer and the collected developer in a second direction opposite to the first direction while agitating the developers, the developer agitation conveyance path supplying the agitated developers to the developer supply conveyance path; and at least one of the latent image carrying member, a charging device configured to charge the latent image carrying member, and a cleaning device configured to clean a surface of the latent image carrying member.

16. An image forming apparatus, comprising:

a latent image carrying member configured to carry a latent image; and a development device configured to develop the latent image including, a developer carrying member configured to rotate while bearing thereon a two-component developer including a magnetic carrier and a toner, and configured to supply the toner to a latent image on a surface of a latent image carrier in a development region, in which the developer carrying member faces the latent image carrier, a developer supply conveyance path including a developer supply conveyance member supplying the two-component developer to the developer carrying member and not receiving the two-component developer from the developer carrying member, the developer supply conveyance path conveying the two-component developer in a first direction, a developer collection conveyance path including a developer collection conveyance member configured to collect a developer from the developer carrying member after the developer is passed through the development region, and conveying the collected developer in the first direction, and a developer agitation conveyance path including a developer agitation conveyance member configured to receive an excess developer unused for development and the collected developer and configured to convey the excess developer and the collected developer in a second direction opposite to the first direction while agitating the developers, the developer agitation conveyance path supplying the agitated developers to the developer supply conveyance path.

17. The image forming apparatus of claim 16, further comprising:

a charging device configured to charge the latent image carrying member.

18. The image forming apparatus of claim 17, further comprising:

a cleaning device configured to clean a surface of the latent image carrying member, wherein the development device and at least one of the charging device, the cleaning device, and the latent image carrying member are integrated as a unit.

19. A development device, comprising:

means for rotating while bearing thereon a two-component developer including a magnetic carrier and a toner, and the means for rotating supplies the toner to a latent image on a surface of a latent image carrier in a development region, in which the means for rotating faces the latent image carrier;

means for supplying the two-component developer to the means for rotating and not receiving the two-component developer from the means for rotating, the means for supplying conveying the two-component developer in a first direction; and means for collecting a developer collected from the means for rotating after the developer is passed through the development region;

means for conveying the collected developer in the first direction; and means for receiving unused developer and conveying the unused developer in a second direction opposite to the first direction.

* * * * *